US009474368B2

(12) United States Patent
Frankel et al.

(10) Patent No.: US 9,474,368 B2
(45) Date of Patent: Oct. 25, 2016

(54) FOLDABLE SHELF

(71) Applicant: Zenithen USA LLC, Diamond Bar, CA (US)

(72) Inventors: Andrew David Frankel, Yorba Linda, CA (US); Shi-Ping Zheng, Fuzhou (CN); Tian-Xia Zheng, Fujian (CN)

(73) Assignee: Zenithen USA, LLC, Diamond Bar, CA (US)

( * ) Notice: Subject to any disclaimer, the term of this patent is extended or adjusted under 35 U.S.C. 154(b) by 0 days.

(21) Appl. No.: 14/479,299

(22) Filed: Sep. 6, 2014

(65) Prior Publication Data

US 2016/0066687 A1 Mar. 10, 2016

(51) Int. Cl.

| | |
|---|---|
| ***A47B 13/00*** | (2006.01) |
| ***A47B 43/00*** | (2006.01) |
| ***A47F 5/10*** | (2006.01) |
| ***A47B 55/02*** | (2006.01) |

(52) U.S. Cl.

CPC ..... *A47B 43/00* (2013.01); *A47B 55/02* (2013.01); *A47F 5/10* (2013.01)

(58) Field of Classification Search

CPC ..... A47B 43/00; A47B 46/00; A47B 47/00; A47B 47/02; A47B 47/021; A47B 55/02; A47B 57/00; A47F 5/116; A47F 5/10; A47F 5/13; A47F 5/01; A47F 5/12; A47F 5/0031

USPC ..... 211/149, 204, 260, 181.1, 189; 108/162, 163, 166–168, 170–173, 175

See application file for complete search history.

(56) References Cited

U.S. PATENT DOCUMENTS

| | | | | |
|---|---|---|---|---|
| 2,938,632 | A * | 5/1960 | Mondineu | 108/106 |
| 3,093,247 | A * | 6/1963 | Erickson | A47B 31/04 108/188 |
| 3,777,674 | A * | 12/1973 | Parsons | A47B 3/083 108/175 |
| 4,740,010 | A * | 4/1988 | Moskovitz | A47B 31/04 108/170 |
| 6,349,962 | B1 * | 2/2002 | Johanson | B62B 3/02 280/42 |
| 7,080,640 | B2 * | 7/2006 | Sanders et al. | 126/30 |
| 7,389,887 | B2 * | 6/2008 | Liang | 211/149 |
| 8,672,147 | B2 * | 3/2014 | Lam | 211/149 |
| 2010/0326938 | A1 * | 12/2010 | Zhu et al. | 211/149 |

* cited by examiner

*Primary Examiner* — Brian Glessner
*Assistant Examiner* — Paola Agudelo
(74) *Attorney, Agent, or Firm* — Merek, Blackmon & Voorhees, LLC

(57) ABSTRACT

The invention relates to a foldable shelf consisting of vertical frames at both ends, two layers at least, link rods and two cross rods connecting the upper and lower layer. Each layer includes two symmetric pieces hinged into a foldable structure between the two frames, and the two layer ends are separately hinged to the frame. One end of the cross rod is hinged to a sleeve which is movably attached to the link rod; the shelf is characterized in that: the cross rod is an "L" shaped structure with a transverse rod and a vertical rod, in which the former crosses and is hinged to both sides of the frame, and the end of the latter is hinged to the sleeve. By the "L" shaped cross rod, both frames form a rigid, triangular and a stable structure with a vertical plane of the shelf, and the entire structure is more cost effective and practical.

3 Claims, 5 Drawing Sheets

FOLDABLE SHELF

BACKGROUND OF THE INVENTION

1. Field of the Invention

This invention belongs to the field of foldable furniture, and in particular, relates to a foldable shelf.

2. Description of the Prior Art

Patent CN2827121Y introduces a portable foldable shelf as shown in FIG. 7, consisting of two side frames carrying shelf layers, in which: 1) it has at least two layers up and down between the two side frames; 2) each layer has two symmetric pieces hinged together; 3) hinges of the upper and lower layers are connected via link rods; 4) the two ends of each layer are separately hinged to the two side frames; 5) it has a sleeve connector on the link rod, the sleeve is movably set on the link rod, and the sleeve connector has two side cross rods separately hinged to the two side frames. The patent flexibly uses the hinge mechanism so that layers and frames can be folded, and the folded structure is small and portable; but the two side frames are only movably hinged to layers, so the rectangular twist disposition formed between the two side frames and two vertical planes of layers cannot be overcome, even by adding two cross rods to the sleeve connector to form a triangular support to layers, and the layers may still shake in use. Moreover, the layers are connected by link rods which are suspended and cannot support the middle point of each layer, however, the middle point of each layer is the main load carrying position, and thus the shelf vertical plane width is limited. This invention aims to improve the existing technique.

None of the above inventions and patents, taken either singly or in combination, is seen to describe the instant invention as claimed.

SUMMARY OF THE INVENTION

This invention according to at least one embodiment teaches a design for a foldable shelf in which a stable angular structure can be formed between the shelf layer vertical plane and the frame vertical plane by "L" shaped cross rods; and at least one link rod can support from the ground to the layer midpoint.

This invention is realized in part by: a foldable shelf consisting of vertical frames at both ends, preferably at least two layers, link rods and two cross rods connecting the upper and lower layer. Each layer preferably consists of two symmetric pieces hinged into a foldable structure between the two frames. The two layer ends are separately hinged to the frame. One end of the cross rod is hinged to a sleeve which is movably attached to the link rod. The shelf is characterized in that: the cross rod is an "L" shaped structure with a transverse rod and a vertical rod. The transverse rod crosses and is hinged to both sides of the frame, and the vertical rod end is hinged to the sleeve.

A supportive buckle is set to the vertical rod of cross rod. When the shelf is folded, the shelf edge can be buckled so that the folded shelf can be locked. When the shelf is unfolded, the shelf edge can be supported by the buckle.

The link rod is a piece-wise structure, and the two symmetric pieces of each layer are separately hinged to the link rod to form a foldable structure.

The shelf system preferably has two link rods, namely, a first link rod and a second link rod, separately set at both side of the shelf. The sleeve is movably attached to the first link rod. When the shelf is unfolded, the sleeve supports the bottom edge of upper layer. The bottom end of the second link rod extends downwards to the ground, and thus a load carrying support is formed.

The shelf system has a reinforcing rod between the first link rod and the second link rod, which is a shape "Z" structure, and its two ends are separately fixed to the first link rod and the second link rod.

The shelf system has a top layer frame between the two frames at both sides, of which, each of the two ends has two downward buckles. The top of the two frames has two opposite pins corresponding to the top frame buckles; by matching each buckle and each pin, the top frame layer is locked at the tops of two frames.

Each side of the two frames has a pin corresponding to the top frame buckle, and by matching the buckle and the pin at each side, the top frame layer is locked at the sides of two frames.

This invention according to at least one embodiment has the following advantages: 1) by the "L" shaped cross rod, a rigid structure is formed between the two side frames and the shelf vertical plane, i.e. the three vertical planes are stabilized, and the entire shelf is given a stable structure; 2) the second link rod is supported from the ground to the middle point of shelf layer reliably and stably, and thus the shelf layer can carry a heavier load; 3) the first link rod and the second link rod are reinforced by a shape "Z" rod, forming a rigid and integrated support to the middle, and thus the defect of weak load carrying capacity in the middle of two foldable pieces of shelf layer is solved; 4) the two side frames are connected by the top layer frame, and the shelf strength is further reinforced; this invention has a more reasonable and practical structure.

These and other objects of the present invention will be readily apparent upon review of the following detailed description of the invention and the accompanying drawings. These objects of the present invention are not exhaustive and are not to be construed as limiting the scope of the claimed invention. Further, it must be understood that no one embodiment of the present invention need include all of the aforementioned objects of the present invention. Rather, a given embodiment may include one or none of the aforementioned objects. Accordingly, these objects are not to be used to limit the scope of the claims of the present invention.

BRIEF DESCRIPTION OF THE DRAWINGS

This invention is further explained by the specific figures as shown below.

Figure 1:
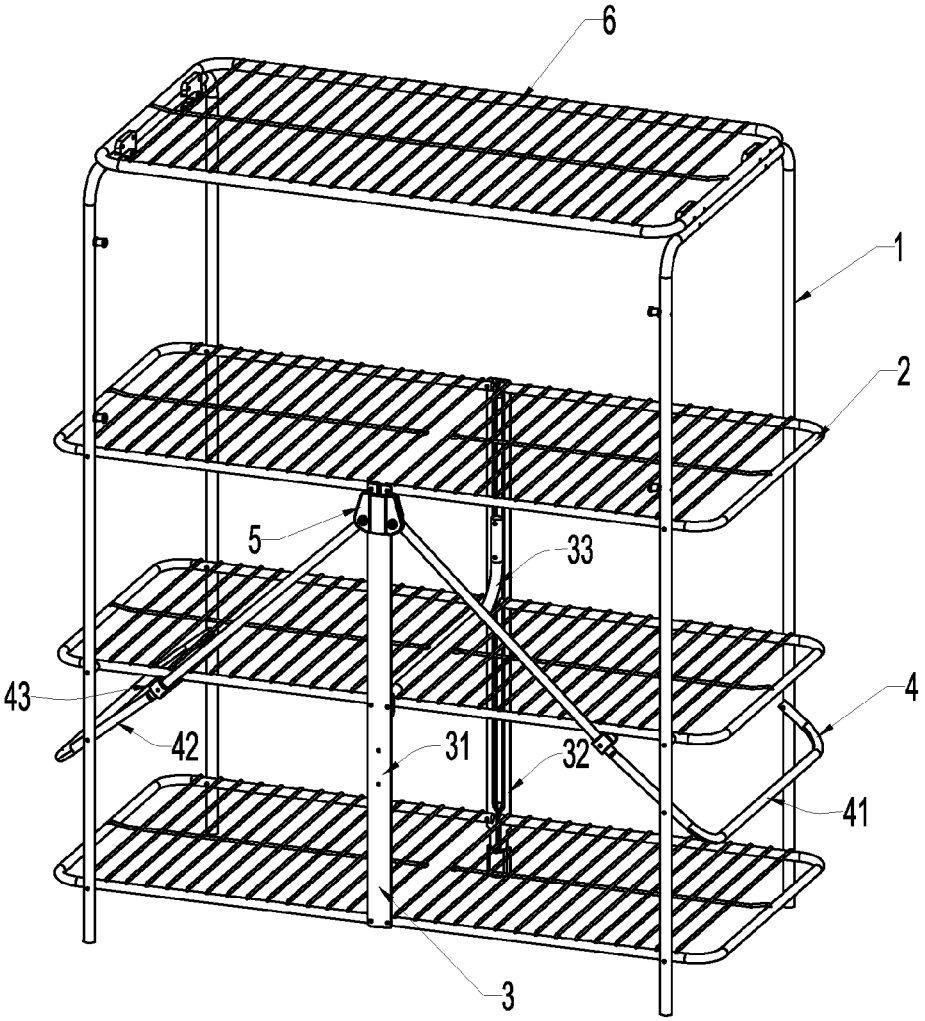
FIG. 1 is a Schematic drawing for the shelf back vertical plane.

In which, the following reference numeral refer to the following elements:

1—Frame
11—Pin
2—Layer
3—Link rod
31—1st link rod
32—2nd link rod
33—Reinforcing rod

4—Cross rod
41—Transversal rod
42—Vertical rod
43—Supportive buckle
5—Sleeve
6—Top layer frame
61—Buckle hook Similar reference characters denote corresponding features consistently throughout the attached drawings.

DETAILED DESCRIPTION OF THE PREFERRED EMBODIMENT(S)

Figure 2:
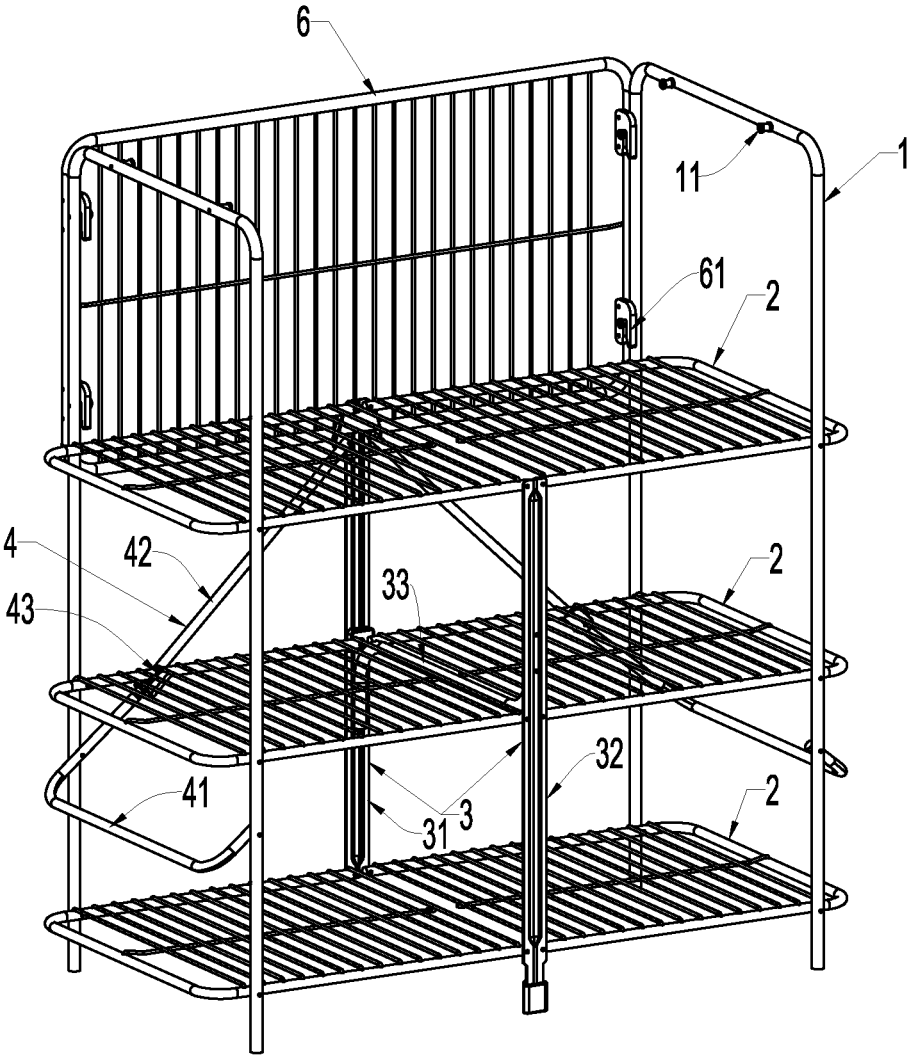
FIG. 2 is a Schematic drawing for the shelf front vertical plane.

Referring to FIG. 1 to FIG. 5, the foldable shelf consists of a vertical frame 1 at both ends, at least two layers 2, a cross rod 3 connecting the upper and lower layers, two cross rods 4 and sleeve 5. In this structure, the cross rod 3 has two pieces, the first link rod 31 and the second link rod 32 separately set at each side of layer 2. The layer 2 has two symmetric pieces separately hinged to the link rod 3 into a foldable structure, and particularly, one side of the layer 2 is hinged to the first link rod 31, and the other side is hinged to the second link rod 32, to be folded around the hinge and attached to the link rod 3 closely. The layer 2 is distributed between the two frames 1, and its two ends are separately hinged to the frame 1. In this practice, the shelf has three layers 2, and can be designed into two or four layers. The sleeve 5 is movably set to the first link rod 31. When the layer 2 is unfolded, the sleeve 5 will support the bottom edge of the top layer 2, also supports the top layer 2 and lifts the first link rod 31. Thus the weight at the middle of layer 2 can be transmitted to the two end frames 1, as shown in FIG. 1. The bottom end of the second link rod 32 extends downwards onto the ground, carries the load and directly supports the other side of layer 2. Thus the foldable layer 2 will not be influenced by the middle hinge, so that the load carried is reduced, as shown in FIG. 2.

Figure 3:
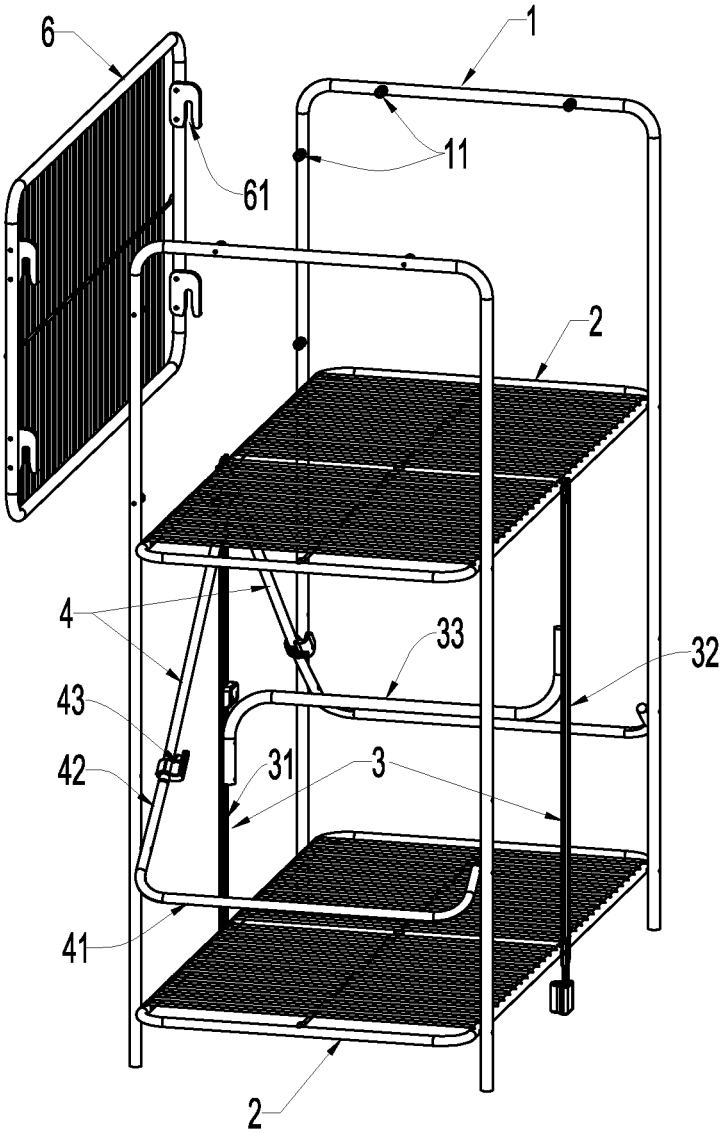
FIG. 3 is an Exploded view of the shelf.
Figure 4:
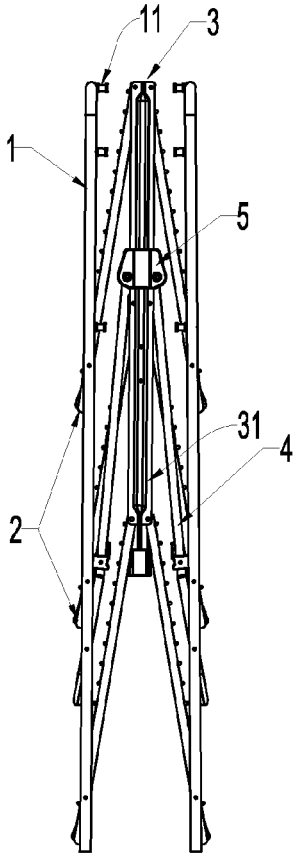
FIG. 4 is a Schematic drawing for the folded shelf.

In FIG. 1 and FIG. 3, the shelving system has a reinforcing rod 33 between the first link rod 31 and the second link rod 32, which is a "Z" shaped structure. The rod's two ends are separately fixed to the first link rod 31 and the second link rod 32, and the two link rods are connected into a rigid structure so that the middle of layer 2 can be reliably supported and protected from twisting incurred when carrying/supporting unbalanced loads.

Figure 5:
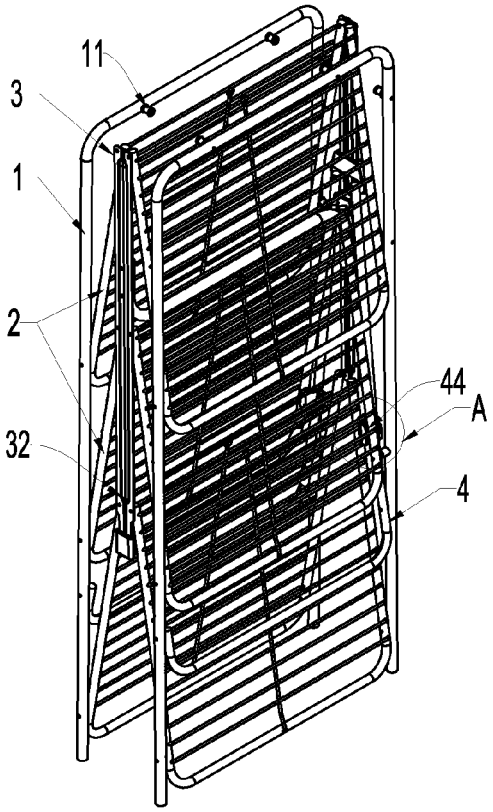
FIG. 5 is a 3D schematic drawing for the folded shelf.
Figure 6:
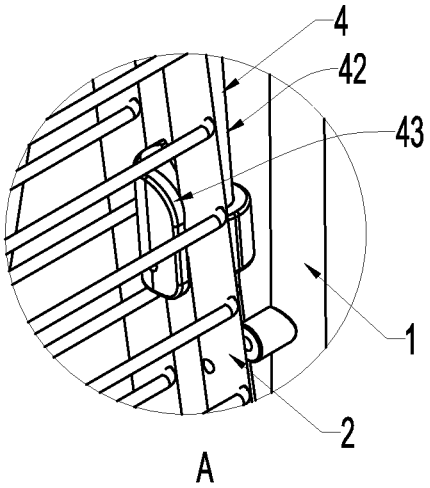
FIG. 6 is an Enlarged drawing for FIG. 5-A.
Figure 7:
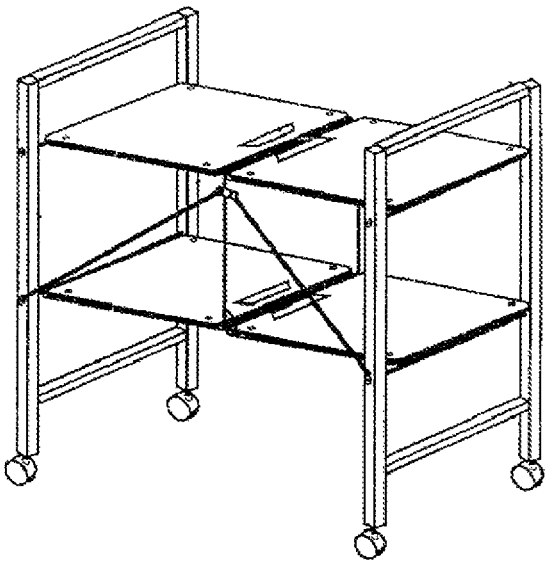
FIG. 7 is a 3D schematic drawing for the existing technique.

In FIG. 1, FIG. 2 and FIG. 3, the cross rod 4 in this structure is an "L" shaped rod with a transversal rod 41 and a vertical rod 42, in which, the former crosses and is hinged to both sides of frame 1. In particular, the two hinges form a revolving structure; the latter is hinged to the sleeve 5, by the shape "L" rigid angle, so that the two end frames 1 and the vertical shelf plane form a rectangular rigid structure to avoid quadrangular twist under any load, and the shelf can stand more stably as it is an innovation of this invention. In FIG. 5 and FIG. 6, the shelf system has a supportive buckle 43 at the vertical rod 42 of cross rod 4. When the shelf is folded, the edge of layer 2 can be buckled by the supportive buckle 43 into a position locked structure to avoid the spreading ("unfolding") of folded shelf. The supportive buckle 43 can also support the edge of unfolded layer 2, and be used as an auxiliary support to the layer 2.

In FIG. 1, FIG. 2 and FIG. 3, the shelf unit has a top layer frame 6 between the two end frames 1, which can be locked to the top of frame 1 or locked to the side of frame 1. Details of the locking mechanism are as follows: 1) it has two downward buckle hooks 61 at each end edge of the top layer frame 6, and it has two opposite pins 11 at the top of the two end frames 1, corresponding to the buckle hook 61; the top layer frame 6 is locked at the frame top by the match between the buckle hook 61 and the pin 11, as shown in FIG. 1; 2) based on the above structure, pins 11 are set at both sides of the two end frames 1, corresponding to the buckle hooks 61 at the top layer frame, and the top layer frame 6 is locked to the side of frame 1 by the match between buckle hook 61 and pin 11 at the side of frame 1, as shown in FIG. 2. With the help of frame 6, the layers can be added, or a dust or rain sheild can be added and supported by the top layer frame 6, a 4-point positioned structure can be formed by the top layer frame 6 and the two end frames 1, and thus the rigid strength of shelf is further improved.

In the above practice, frames 1 and layers 2 are made of pipes/tubing with round angles. The cross rod 4 is also a shape "L" structure made of a bent pipe. The transversal rod 41 is equivalent to the bent shape "U" bottom. In particular, the cross rod 4 crosses and is hinged to both sides of frame 11 via a shape "U" bottom, and the two hinges are at a similar axis, a structure equivalent to the rectangular bent transversal rod 41. This invention is similarly applicable to a layer board structure.

While this invention has been described as having a preferred design, it is understood that it is capable of further modifications, uses and/or adaptations of the invention following in general the principle of the invention and including such departures from the present disclosure as come within the known or customary practice in the art to which the invention pertains and as maybe applied to the central features hereinbefore set forth, and fall within the scope of the invention and the limits of the appended claims. It is therefore to be understood that the present invention is not limited to the sole embodiment described above, but encompasses any and all embodiments within the scope of the following claims.

We claim:

1. A foldable shelf comprising:

a pair of link rods, a right frame and a left frame;

an upper shelf formed by right and left symmetric pieces; the right and left upper shelf pieces hingedly connected to the pair of link rods at the center of the upper shelf so that the right and left upper shelf pieces can rotate relative to each other into a storage position;

a lower shelf formed by right and left symmetric pieces; the right and left lower shelf pieces hingedly connected to the pair of link rods at the center of the lower shelf so that the right and left lower shelf pieces can rotate relative to each other into the storage position;

said upper shelf right shelf piece connected to said lower shelf right piece by said right frame;

said upper shelf left shelf piece connected to said lower shelf left piece by said left frame;

at least one L shaped cross rod hingedly connected to said right frame and hingedly connected to a sleeve slidably mounted about a one of said pair of link rods;

wherein when the shelf is unfolded, the sleeve supports a bottom edge of said upper shelf;

a bottom end of the link rod carrying the sleeve; and a lower end of the right and left frames each extends to the ground to support the upper and lower shelves; and further comprising a Z shaped reinforcing rod having one end of the reinforcing rod connected to a first link rod of the pair of link rods and a second end of the reinforcing rod connected to a second link rod of the pair of link rods.

2. The foldable shelf according to claim 1, comprising a buckle to lock said foldable shelf in the storage position.

3. A foldable shelf comprising:

a pair of link rods and a right frame and a left frame:

an upper shelf formed by right and left symmetric pieces; the right and left upper shelf pieces hingedly connected to the pair of link rods at the center of the upper shelf so that the right and left upper shelf pieces can rotate relative to each other Into a storage position;

a lower shelf formed by right and left symmetric pieces; the right and left lower shelf pieces hingedly connected to the pair of link rods at the center of the lower shelf so that the right and left lower shelf pieces can rotate relative to each other Into the storage position;

said upper shelf right shelf piece connected to said lower shelf right piece by said right frame;

said upper shelf left shelf piece connected to said lower shelf left piece by said left frame;

at least one L shaped cross rod hingedly connected to said right frame and hingedly connected to a sleeve slidably mounted about a one of said pair of link rods;

wherein the right frame is U shaped and has a right and left leg, wherein said upper shelf right shelf piece is connected to both said right leg and said left leg; and wherein said L shaped cross rod structure includes a transverse rod and a vertical rod connected to each other at a right angle, wherein the transverse rod is connected to both said right leg and said left leg.

* * * * *